US008695691B2

(12) United States Patent
Kotrla et al.

(10) Patent No.: US 8,695,691 B2
(45) Date of Patent: Apr. 15, 2014

(54) SUBSEA CONNECTION APPARATUS FOR A SURFACE BLOWOUT PREVENTER STACK

(75) Inventors: Johnnie E. Kotrla, Katy, TX (US); Joe S. Johnson, Houston, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 13/369,751

(22) Filed: Feb. 9, 2012

(65) Prior Publication Data

US 2012/0199360 A1 Aug. 9, 2012

Related U.S. Application Data

(63) Continuation of application No. 12/833,710, filed on Jul. 9, 2010, now Pat. No. 8,136,598, which is a continuation of application No. 10/304,240, filed on Nov. 26, 2002, now Pat. No. 7,779,917.

(51) Int. Cl.
*E21B 33/06* (2006.01)

(52) U.S. Cl.
USPC ..... 166/55; 166/85.4; 251/1.1; 251/1.3

(58) Field of Classification Search
USPC ..... 166/55, 85.4; 251/1.1–1.3
See application file for complete search history.

(56) References Cited

U.S. PATENT DOCUMENTS

| | | | | |
|---|---|---|---|---|
| 2,070,888 | A * | 2/1937 | Eschenbrenner | 138/141 |
| 2,986,847 | A * | 6/1961 | Sato | 29/890.15 |
| 3,103,976 | A | 9/1963 | De Vries et al. | |
| 3,147,992 | A | 9/1964 | Haeber et al. | |
| 3,179,179 | A | 4/1965 | Kofahl | |
| 3,259,198 | A | 7/1966 | Montgomery et al. | |
| 3,265,130 | A | 8/1966 | Watkins | |
| 3,516,447 | A * | 6/1970 | Pittman, Jr. | 138/109 |
| 3,716,068 | A | 2/1973 | Addison | |
| 3,736,982 | A | 6/1973 | Vujasinkovic | |
| 3,817,326 | A | 6/1974 | Meynier, III | |
| 4,080,797 | A | 3/1978 | Thompson | |
| 4,193,455 | A | 3/1980 | Steddum et al. | |
| 4,476,935 | A * | 10/1984 | Hynes et al. | 166/373 |
| 4,995,427 | A * | 2/1991 | Berchem | 138/155 |
| 5,069,485 | A * | 12/1991 | Allen et al. | 285/55 |
| 5,727,640 | A | 3/1998 | Gleditsch | |
| 5,848,656 | A | 12/1998 | Moksvold | |

(Continued)

FOREIGN PATENT DOCUMENTS

| | | | |
|---|---|---|---|
| EP | 0709545 | A2 | 5/1996 |
| WO | 02/088516 | A1 | 11/2002 |

*Primary Examiner* — Giovanna Wright
(74) *Attorney, Agent, or Firm* — Chamberlain Hrdlicka

(57) ABSTRACT

A subsea connection apparatus to allow connecting a surface blowout preventer stack and riser to a subsea wellhead is disclosed. The subsea connection apparatus uses a single cavity blowout preventer with a set of shearing blind rams. Hydraulically actuated wellhead connectors are secured to the top and bottom of the blowout preventer to allow connection to a subsea wellhead below the subsea connection apparatus and a well head hub profile on the lower end of a riser above the apparatus. A control system can operate both of the hydraulically actuated connectors and the blowout preventer independently. A frangible bore protector is disposed in the bore of the blowout preventer to protect the shearing blind rams from pipe, tools, and fluids being passed through the blowout preventer and can be sheared by the shearing blind rams along with any drill pipe in the bore.

17 Claims, 7 Drawing Sheets

(56) References Cited

U.S. PATENT DOCUMENTS

| | | | | |
|---|---|---|---|---|
| 5,881,815 | A | 3/1999 | Horton, III | |
| 5,955,162 | A * | 9/1999 | Loving et al. | 428/34.5 |
| 6,672,390 | B2 | 1/2004 | Azancot | |
| 6,823,950 | B2 | 11/2004 | von Eberstein et al. | |
| 7,779,917 | B2 | 8/2010 | Kotrla et al. | |
| 2010/0288504 | A1 | 11/2010 | Kotrla et al. | |

* cited by examiner

SUBSEA CONNECTION APPARATUS FOR A SURFACE BLOWOUT PREVENTER STACK

CROSS REFERENCE TO RELATED APPLICATIONS

This application is a continuation of U.S. patent application Ser. No. 12/833,710, filed on Jul. 9, 2010, and entitled "Subsea Connection Apparatus for a Surface Blowout Preventer Stack," which is herein incorporated by reference in its entirety for all purposes, and which is a continuation of U.S. patent application Ser. No. 10/304,240, filed on Nov. 26, 2002, issued as U.S. Pat. No. 7,779,917 on Aug. 24, 2010, and entitled "Subsea Connection Apparatus for a Surface Blowout Preventer Stack," which is herein incorporated by reference in its entirety for all purposes.

BACKGROUND OF THE INVENTION

1. Field of the Invention

This invention relates to a subsea connection apparatus for connecting a surface blowout preventer stack and riser to a subsea wellhead. This unique subsea connection apparatus uses a single cavity blowout preventer with a set of shearing blind rams disposed therein. Hydraulically actuated wellhead connectors are secured to the top and bottom of the single cavity blowout preventer. The wellhead connectors are oriented to allow connection to a subsea wellhead disposed below the subsea connection apparatus and a wellhead hub profile on the lower end of a riser disposed above the apparatus. The riser extends upwardly to connect to a surface blowout preventer stack on the drilling rig above.

The idea of locating a Blowout Preventer (BOP) stack on the ocean surface to provide well control while drilling for offshore oil is not new. When the first land rig was mounted on a barge decades ago, these systems were common. Later, jack-up rigs were outfitted with such systems. Jack-up rig evolution allowed their water depth capability to be expanded to 650 ft. Then, semi-submersible rigs and drillships were developed and the blowout preventers were moved to the sea floor allowing a relatively low-pressure (and thus, less expensive) riser to transport the drilling mud returns back to the mud processing equipment located in the rig by way of the riser annulus. This seabed BOP configuration facilitated the original water depth expansion to 1500 ft. with second generation rigs, and later to 3,000 ft. with third generation rigs. As time passed, the water depth capability had been extended to 10,000 ft. as larger and much more expensive fourth and fifth generation rigs gradually came into service in the 1990s.

In an effort to allow the more economical second and third generation rigs to drill in water depths in excess of 3,000 ft. the surface stack application has been resurrected. Unlike the systems used on jack-up rigs, these latest applications use casing pipe as the riser from the seabed to the surface. This provided several advantages over using subsea stacks. First, the casing could be run much faster than a subsea riser, reducing trip time. Second, the casing pipe used as riser for one well would be cemented into the seabed on the next well, negating the need for fatigue analysis on the riser pipe. In addition to this time and analysis savings, all this could be accomplished with a rig day-rate savings of $50,000/day or more.

However, there was a serious drawback to this application. With the riser cemented into the seabed and the BOP stack latched atop it at the surface, the consequences of riser failure become much more serious than with conventional low pressure riser/subsea stack applications. There is any number of situations that could cause riser failure. In all of these cases, the wellbore would be open to the sea, which is a situation to be avoided because, at best, losing the riser's mud column weight could lead to loss of well control, and at worst, the wellbore formation fluids and pressures would be vented to the sea. These results could easily be an environmental disaster, as well as posing the possibility of injury to rig personnel and rig equipment damage.

There is therefor a need for a simple, cost effective and expendable apparatus that allows the use of surface blowout preventers in combination with a low cost riser to be used in subsea drilling applications. Such a system should allow the use of existing subsea drilling equipment and technology and require minimal modifications to the rig.

2. Description of Related Art

A subsea drilling riser disconnect system and the method of its use are disclosed in Patent Cooperation Treaty International Publication Number WO 02/088516 A1 and invented by Peter E. Azancot.

SUMMARY OF THE INVENTION

The subsea connection apparatus of the present invention is designed to allow connecting a standard surface blowout preventer stack and riser to a subsea wellhead for use in oil and gas drilling operations. This unique subsea connection apparatus uses a single cavity blowout preventer with a set of shearing blind rams disposed therein. Hydraulically actuated wellhead connectors are secured to the top and bottom of the single cavity blowout preventer. The wellhead connectors are oriented to allow connection to a subsea wellhead disposed below the subsea connection apparatus and a wellhead hub profile on the lower end of a riser disposed above the apparatus. The riser extends upwardly to connect to a surface blowout preventer stack on the drilling rig above.

A control system is mounted on a simple framework positioned around the subsea connection apparatus. The control system may be an electrically controlled or acoustically controlled system, whichever system fits the operator's requirements. The control system can operate both of the hydraulically actuated connectors and the blowout preventer independently. A frangible bore protector is disposed in the bore of the blowout preventer to protect the shearing blind rams from pipe and tools being passed through the blowout preventer. The bore protector is constructed of a suitably soft and frangible material to allow the bore protector to be sheared by the shearing blind rams along with any drill pipe in the bore.

A principal object of the present invention is to provide a subsea connection apparatus for connecting a standard surface blowout preventer stack and riser to a subsea wellhead. The subsea connection apparatus is designed to allow shutting in the well at the sea floor and disconnecting the riser from the subsea connection apparatus.

Another object of the present invention is to provide a subsea connection apparatus for connecting a standard surface blowout preventer stack and riser to a subsea wellhead that allows disconnection and reconnection of the subsea connection apparatus in the event the rig is driven off location.

A final object of the present invention is to provide a subsea connection apparatus for connecting a standard surface blowout preventer stack and riser to a subsea wellhead that allows a conventional subsea blowout preventer stack to be connected to the subsea connection apparatus to allow circulation and reclamation of the well.

These with other objects and advantages of the present invention are pointed out with specificness in the claims annexed hereto and form a part of this disclosure. A full and complete understanding of the invention may be had by reference to the accompanying drawings and description of the preferred embodiments.

BRIEF DESCRIPTION OF THE DRAWINGS

These and other objects and advantages of the present invention are set forth below and further made clear by reference to the drawings, wherein.

DESCRIPTION OF THE PRESENTLY PREFERRED EMBODIMENTS

Figure 1:
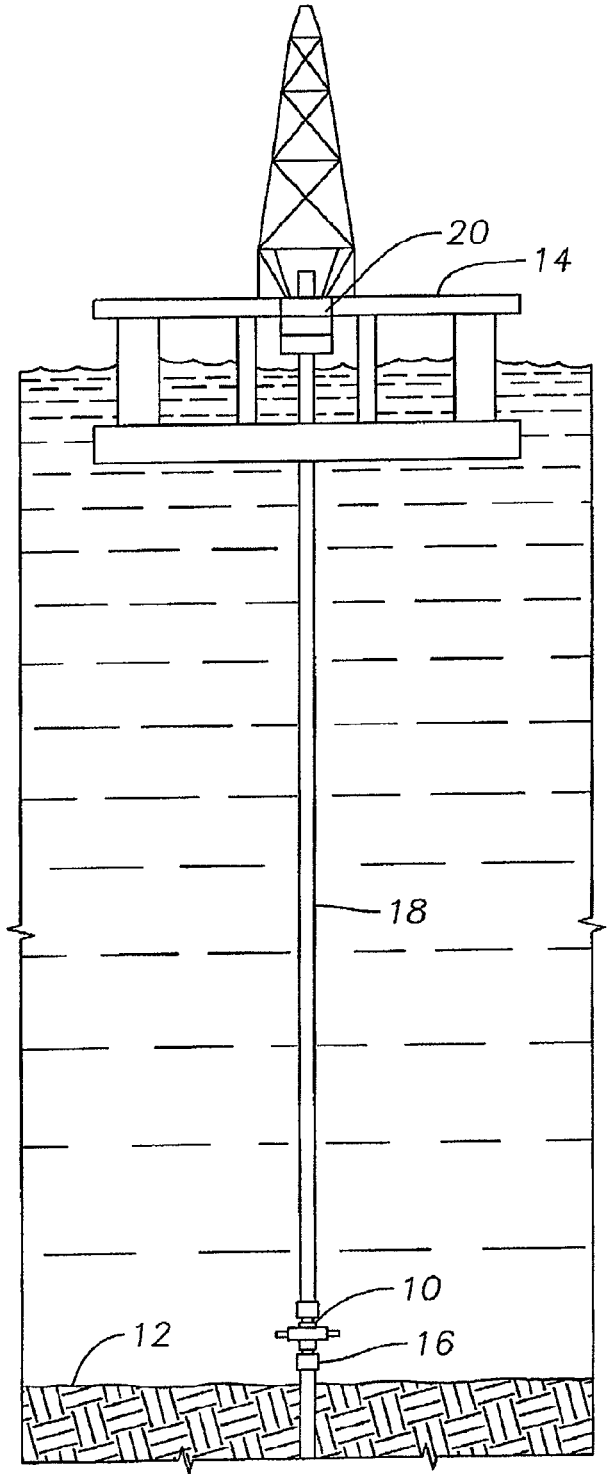
FIG. 1 is an elevational view illustrating a semi-submersible drilling rig connected to a subsea wellhead using the subsea connection apparatus of the present invention in combination with a surface blowout preventer stack.

With reference to the drawings, and particularly to FIG. 1, an elevational view illustrating a semi-submersible drilling rig connected to a subsea wellhead using the subsea connection apparatus of the present invention in combination with a surface blowout preventer stack is shown. The term surface blowout preventer stack is used to refer to a plurality of blowout preventers that are designed for use on land and are not readily suitable for submersion. The subsea connection apparatus 10 of the present invention for connecting a surface blowout preventer stack and riser to a subsea wellhead is shown in FIG. 1. Subsea connection apparatus 10 is shown on the ocean floor 12 in a typical oil and gas drilling operation using a semi-submersible rig 14 or similar floating vessel positioned over subsea wellhead 16. Riser 18 extends from subsea connection apparatus 10 to surface blowout preventer stack 20. Riser 18 may be composed of multiple joints of conventional drilling riser as is well known in the art or may be composed of multiple joints of casing as is typically used for lining a well bore.

Figure 2:
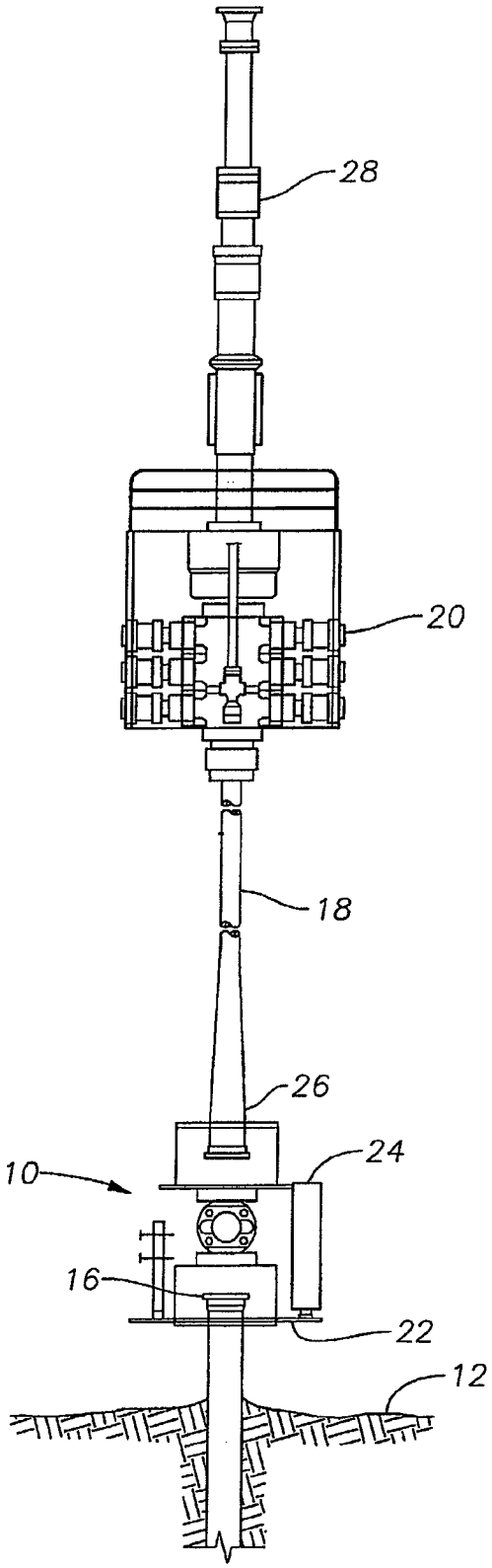
FIG. 2 is an elevational view showing a more detailed view of the subsea connection apparatus of the present invention in combination with a surface blowout preventer stack and riser.

A more detailed view of subsea connection apparatus 10 of the present invention in combination with surface blowout preventer stack 20 and riser 18 is shown in FIG. 2. Subsea connection apparatus 10 has framework 22 positioned thereon which in turn supports control system 24. Control system 24 can be an electrical or acoustic type system as required by the rig operator. Stress joint 26 is positioned between subsea connection apparatus 10 and riser 18 to allow for movement of semi-submersible rig 14 with respect to subsea wellhead 16. Surface blowout preventer stack 20 is positioned atop riser 18 to provide well control in a manner well known to those of ordinary skill in the art. Telescopic joint 28 is secured to surface blowout preventer stack 20 to allow surface blowout preventer stack 20 to move relative to semi-submersible rig 14.

Figure 3:
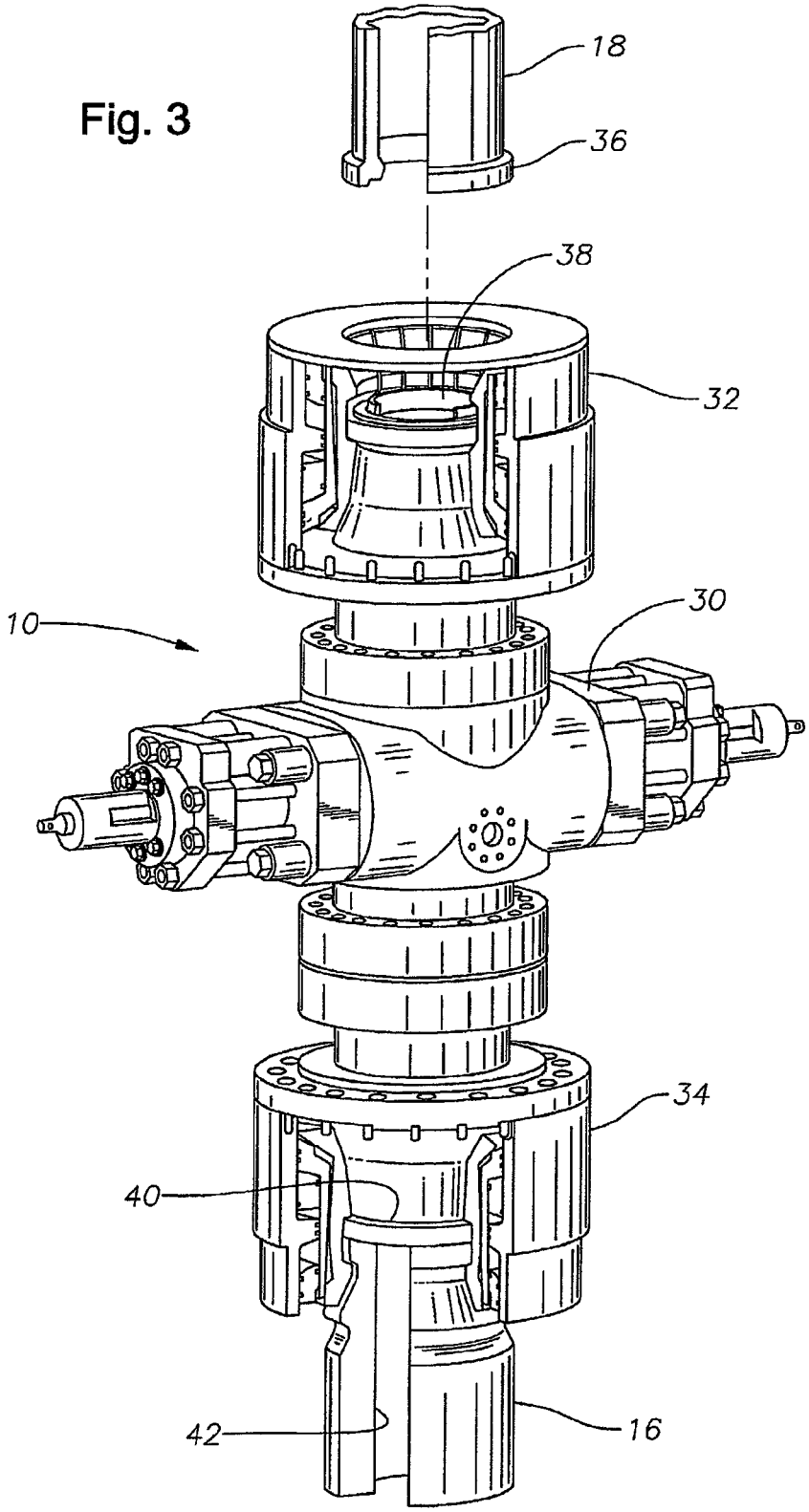
FIG. 3 is a perspective view, partially cutaway, of the subsea connection apparatus for a surface blowout preventer stack of the present invention.

A perspective view, partially cutaway, of subsea connection apparatus 10 is shown in FIG. 3. Framework 22 and control system 24 have been omitted from this view for clarity. Subsea connection apparatus 10 includes a blowout preventer 30 positioned between first and second connection means 32 and 34, respectively, and secured thereto by suitable means as bolting. First and second connection means 32 and 34 take the form of hydraulically actuated wellhead connectors that are operable by control system 24 for disconnecting and reconnecting to wellhead housing 16 and hub profile 36 on the lower end of riser 18. First connection means 32 is oriented in an inverted orientation from its normal use to allow connection and disconnection from hub profile 36 for purposes to be described hereinafter.

Figure 4:
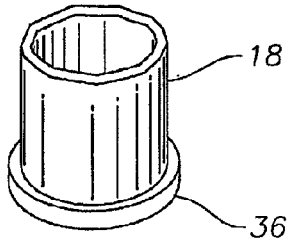
FIG. 4 is a perspective view, partially cutaway, of the subsea connection apparatus for a surface blowout preventer stack of the present invention showing the details of the frangible bore protector in the blowout preventer.
Figure 4:
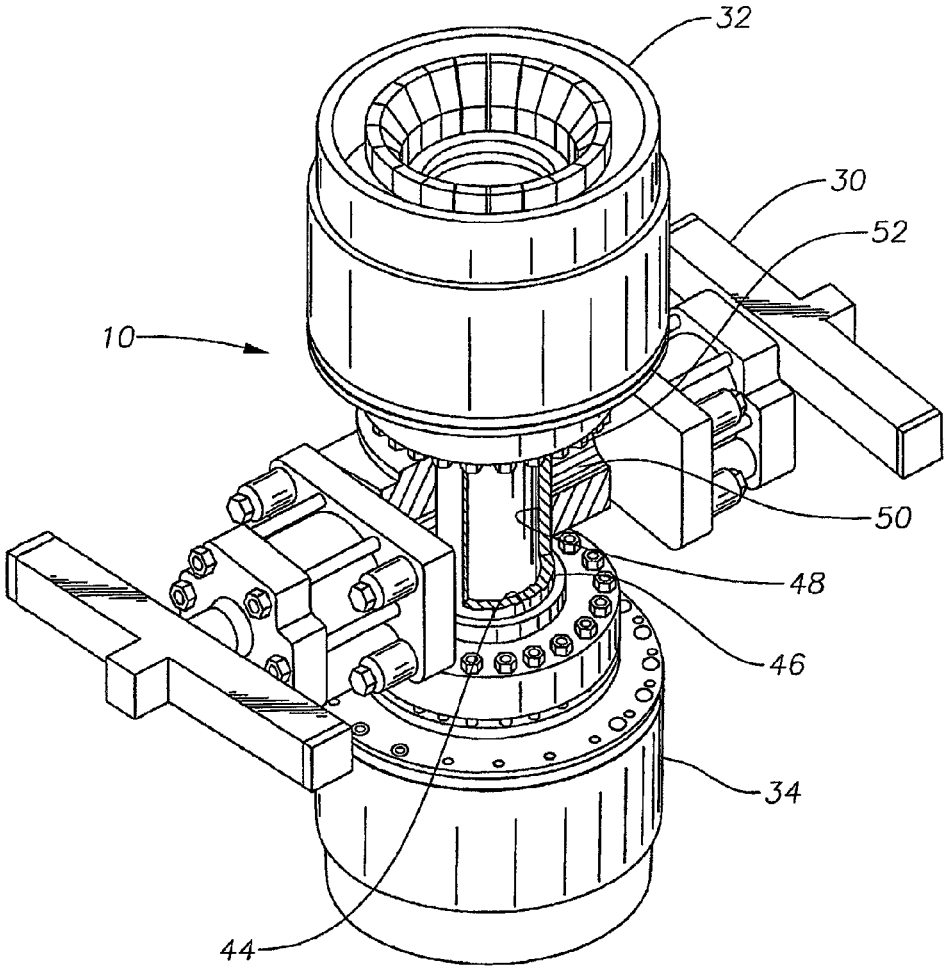

First and second connection means 32 and 34 have bores 38 and 40, respectively, therethrough that are substantially equal to bore 42 in wellhead housing 16 to allow unrestricted passage of components therethrough. As best seen in FIG. 4, blowout preventer 30 has a bore 44 therethrough that is larger than bores 38, 40 and 42 to allow frangible bore protector 46 to be positioned therein. Bore protector 46 in turn has bore 48 therethrough that is substantially equal to bore 38, 40 and 42 to allow unrestricted access therethrough. Adjacent bore protector 46 is ram cavity 50 in which shearing blind rams 52 are positioned for operation in a manner well known to those of ordinary skill in the art. Frangible bore protector 46 is constructed of a suitably soft and frangible material to allow shearing of bore protector 46 by shearing blind rams 52 when required by well bore conditions. Suitable materials include clay, concrete, glass or plastic provided they can be formed to the appropriate shape for insertion in blowout preventer 30 and suitably frangible by shearing blind rams 52.

Figure 5:
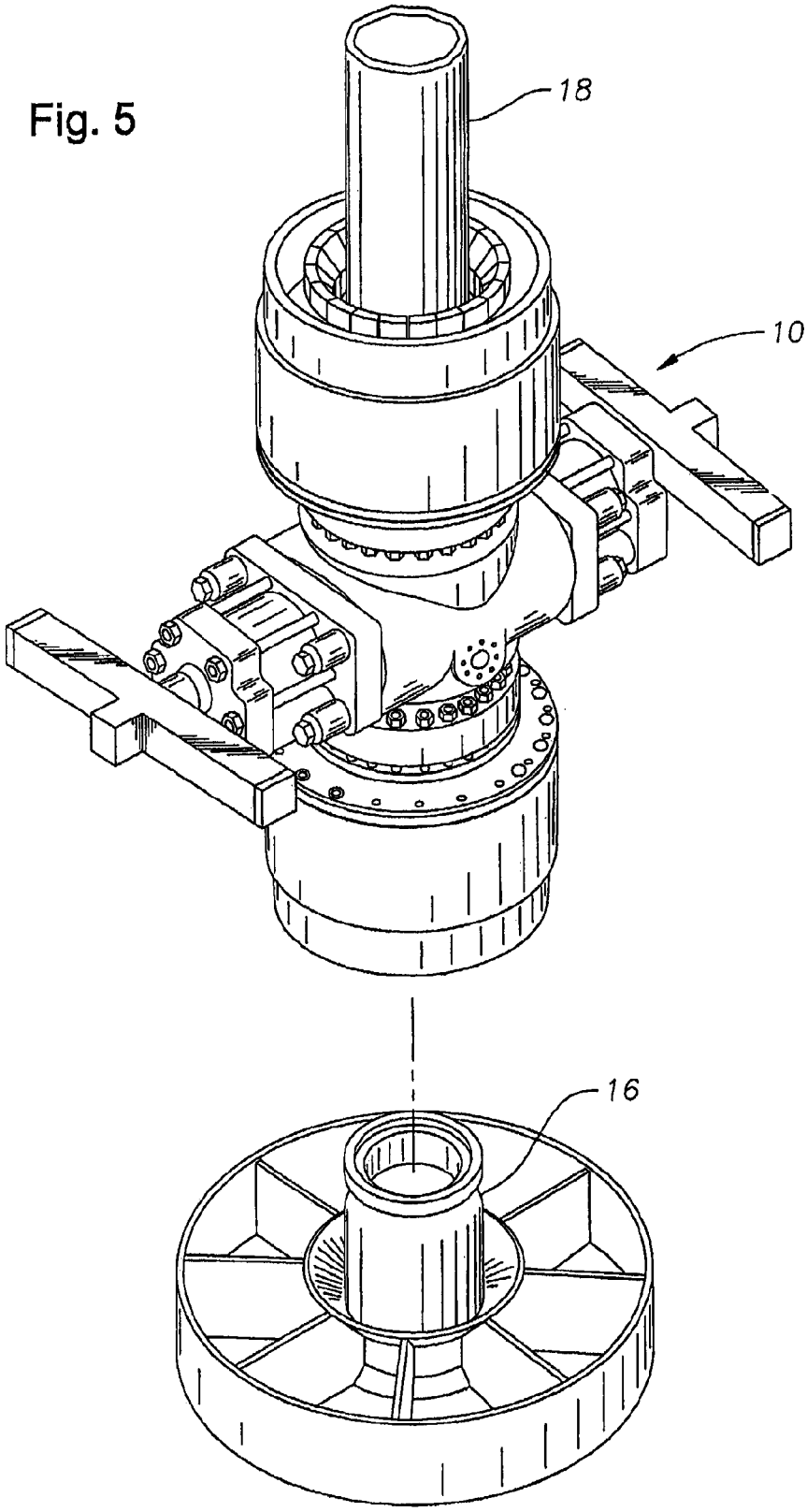
FIG. 5 is a perspective view of the subsea connection apparatus for a surface blowout preventer stack of the present invention disconnected from the subsea wellhead below.

Subsea connection apparatus 10 may be used in a variety of ways depending on the well conditions. As shown in FIG. 5, if a planned disconnect is done, with the well killed and inert, control system 24 allows the sequential closing of shearing blind rams 52 and thereby retaining drilling fluid in riser 18 and then operation of second hydraulically actuated wellhead connector 34 to allow disconnecting from subsea wellhead 16. At this point, if desired, the assemblage of riser 18 and subsea connection apparatus 10 can be moved to an adjacent wellhead and reconnected without requiring the retrieval of subsea connection apparatus 10 or the evacuation of drilling fluid from riser 18. In a drilling program with closely spaced wellheads as in a manifold, this can result in a considerable cost savings.

Figure 6:
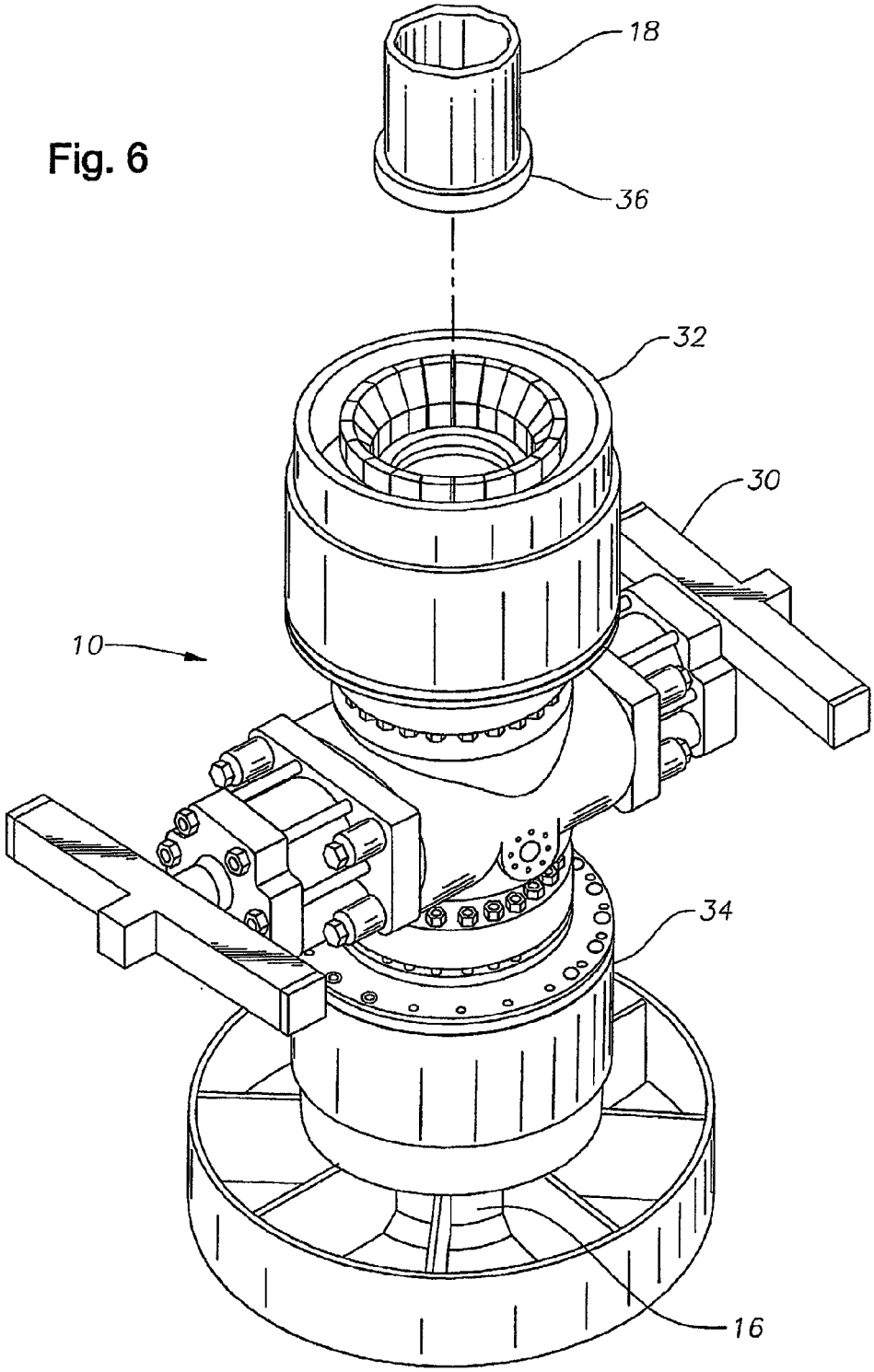
FIG. 6 is a perspective view of the subsea connection apparatus for a surface blowout preventer stack of the present invention with the riser above disconnected as in the case of a rig driveoff.

FIG. 6 depicts the situation where subsea connection apparatus 10 is used in the event of an unplanned disconnection or driveoff. In this case, subsea connection apparatus 10 is left connected to subsea wellhead 16 with second hydraulically actuated wellhead connector 34. First hydraulically actuated wellhead connector 32 is actuated to allow disconnecting hub profile 36 and riser 18 from subsea connection apparatus 10 and subsea wellhead 16. Additionally, with subsea connection apparatus 10 left in place, blowout preventer 30 can be actuated to allow shearing blind rams 52 to shear frangible bore protector 46 along with any drill pipe that is in the wellbore. This ensures well pressure is contained within subsea wellhead 16 and prevents any blowout of the well.

Figure 7:
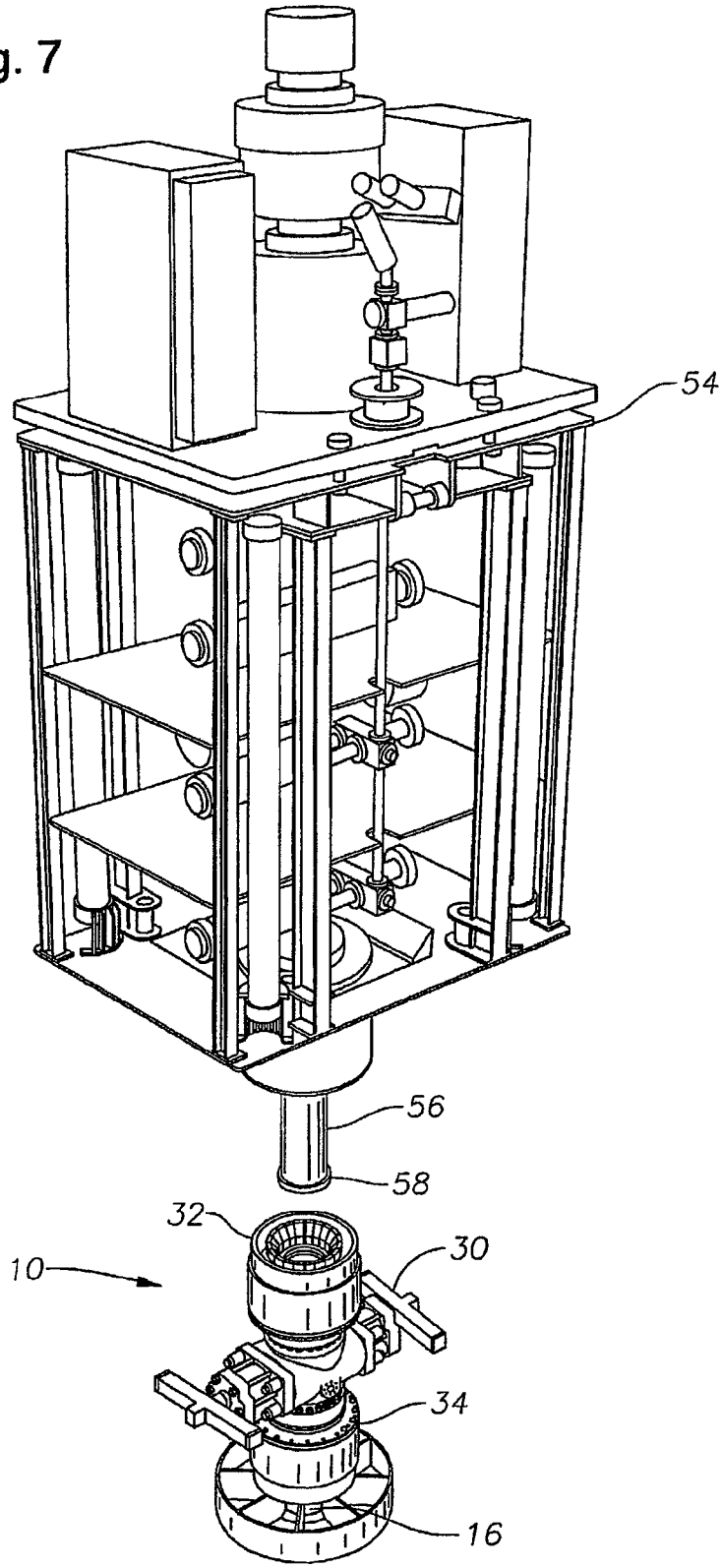
FIG. 7 is a perspective view of the subsea connection apparatus for a surface blowout preventer stack of the present invention with a subsea blowout preventer stack being reconnected to the subsea connection apparatus.

FIG. 7 shows the situation where it is desired to reenter subsea wellhead 16 after an emergency disconnect as shown in FIG. 6. In this case a conventional subsea blowout preventer stack 54 is used to regain well bore pressure control. Subsea blowout preventer stack 54 has a large diameter stinger 56 extending below with hub profile 58 formed thereon. Stinger 56 is sized to give full bore access to wellhead 16. As subsea blowout preventer stack 54 is lowered into position, first hydraulically actuated wellhead connector 32 is operated to allow hub profile 58 to be lowered into connector 32 and then locked thereto. At this point, blowout preventer 30 can be opened and subsea blowout preventer stack 54 can be used to circulate drilling fluid into subsea wellhead 16 and its well bore to regain well control.

Another embodiment of subsea connection apparatus 10 (not shown) can have blowout preventer 30 modified to be a double blowout preventer, i.e., have a pair of ram cavities, one above another. In this case, shearing blind rams 52 would be placed in the upper cavity, and a pair of pipe rams in the lower cavity. This would allow for the circumstance of suspending the drill pipe on the pipe rams of the lower cavity in a manner well known to those of ordinary skill in the art, while shearing the drill pipe above with the shearing blind rams. This type of operation would make it easier to reenter the well and retrieve the suspended drill pipe. Alternatively, each of the ram cavities could have shearing blind rams therein to allow for redundancy in drill pipe shearing operations.

The construction of our subsea connection apparatus for connecting a standard surface blowout preventer stack and riser to a subsea wellhead will be readily understood from the foregoing description and it will be seen that we have provided a subsea connection apparatus that is designed to allow shutting in the well at the sea floor and disconnecting the riser from the subsea connection apparatus and later reentering the well to allow circulation and reclamation of the well. Furthermore, while the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the appended claims.

What is claimed is:

1. An apparatus to protect an annular bore of a blowout preventer configured to be coupled to a wellhead, comprising:
- an annular member comprising:
  - an outer diameter substantially equal to a diameter of the annular bore; and
  - an inner diameter substantially equal to a diameter of a second annular bore of the wellhead; and
- wherein the annular member is frangible.

2. The apparatus of claim 1, wherein the annular bore has a diameter larger than the diameter of the second annular bore.

3. The apparatus according to claim 1, wherein the annular member consists essentially of clay.

4. The apparatus according to claim 1, wherein the annular member consists essentially of glass.

5. The apparatus according to claim 1, wherein the annular member consists essentially of concrete.

6. A blowout preventer assembly, comprising:
- a blowout preventer, comprising:
  - an annular bore;
  - at least one ram cavity radially outboard of the annular bore; and
  - a ram disposed in each ram cavity; and
- a frangible annular member disposed in the annular bore radially inboard of the at least one ram cavity and shearable by each ram.

7. The assembly according to claim 6, wherein the frangible annular member is disposed in the annular bore such that movement of the ram into the annular bore breaks the frangible annular member.

8. The system according to claim 7, wherein the frangible annular member consists essentially of concrete.

9. The system according to claim 6, wherein the annular member is coaxial with the annular bore.

10. The system according to claim 6, wherein the ram is a shear ram.

11. The system according to claim 6, wherein the ram is a blind ram.

12. The system according to claim 6, wherein frangible annular member consists essentially of clay.

13. A wellhead assembly, comprising:
- a blowout preventer comprising:
  - an annular bore;
  - at least one ram cavity radially outboard of the annular bore; and
  - a ram disposed in each ram cavity;
- a frangible annular member disposed in the annular bore radially inboard of the at least one ram cavity and shearable by each ram; and
- a wellhead coupled to the blowout preventer, the wellhead having a second annular bore.

14. The wellhead assembly according to claim 13, wherein an inner diameter of the frangible annular member is greater than or equal to a diameter of the second annular bore.

15. The wellhead assembly according to claim 13, comprising a production casing; wherein an inner diameter of the production casing is less than or equal to an inner diameter of the frangible annular member.

16. The wellhead assembly according to claim 13, wherein the frangible annular member consists essentially of glass.

17. The wellhead assembly according to claim 13, wherein the annular member, the second annular bore and the annular bore are coaxial.

* * * * *